US005153640A

United States Patent [19]

Okabe

[11] Patent Number: 5,153,640

[45] Date of Patent: Oct. 6, 1992

[54] IMAGE RECORDING APPARATUS HAVING A RECORDING UNIT DETACHABLY ASSEMBLED THEREIN WITH A SELECTIVELY OPENED PORTION

[75] Inventor: Yasushi Okabe, Nagoya, Japan

[73] Assignee: Brother Kogyo Kabushiki Kaisha, Nagoya, Japan

[21] Appl. No.: 759,878

[22] Filed: Sep. 13, 1991

[30] Foreign Application Priority Data

Sep. 27, 1990 [JP] Japan ..... 2-257965

[51] Int. Cl.[5] ..... G03G 15/00

[52] U.S. Cl. ..... 355/200; 355/210

[58] Field of Search ..... 355/200, 210, 211, 260

[56] References Cited

U.S. PATENT DOCUMENTS 4,462,677 7/1984 Onoda ..... 355/210
4,470,689 9/1984 Nomura et al. ..... 355/211
4,829,334 5/1989 Takamatsu et al. ..... 355/211 X
5,061,959 10/1991 Kinoshita et al. ..... 355/210

*Primary Examiner*—A. T. Grimley
*Assistant Examiner*—William J. Royer
*Attorney, Agent, or Firm*—Oliff & Berridge

[57] ABSTRACT

A recording unit having an electrostatic latent image carrying member and a developing member, and an image recording apparatus which assembles therein the recording unit. The carrying member is supported on a first casing and the developing member is supported on a second casing pivotally connected to the first casing. The second casing has a developing position in which an opening portion for an image transfer is provided and a blockage position which closes the opening portion. A displacement member is provided between the first and the second casings for normally providing the blockage position. The image recording apparatus includes a drive member engageable with the second casing. The drive member urges the second casing toward the developing position against a biasing force of the displacement members when the recording unit is assembled into the image recording apparatus.

13 Claims, 4 Drawing Sheets

IMAGE RECORDING APPARATUS HAVING A RECORDING UNIT DETACHABLY ASSEMBLED THEREIN WITH A SELECTIVELY OPENED PORTION

BACKGROUND OF THE INVENTION

The present invention relates to a recording unit and an image recording apparatus. More particularly, the invention relates to the recording unit having an electrostatic latent image carrying means and a developing means provided pivotable to a developing position in which the electrostatic latent image carrying means is exposed to an image transfer portion and to a blockage position where the carrying means is shut-off from the image transfer portion. The invention also relates to an image recording apparatus which receives therein the recording unit and which moves the developing means to the developing position and the blockage position.

In a conventional image recording apparatus of an electrophotographic type, intricate maintenance is required such as supply and waste of developer agent and cleaning to a charger. To obviate this intricacy, a recording unit has been provided which integrally accommodates therein a photosensitive drum serving as electrostatic latent image carrier, developer means, a cleaner and a charger. The one integral unit undergoes replacement on a unit basis so as to facilitate maintenance work.

In the conventional recording unit however, since a photosensitive drum portion confronting the charger is exposed to an atmosphere, the photosensitive drum may be damaged or contaminated at the time of disposal of sheet jamming and the unit replacement work. Further, the drum is subjected to degradation due to drum fatigue attendant to external light irradiation to the exposed drum portion.

In order to avoid this drawback, a movable protection cover is provided to the recording unit, where the protection cover is moved away from an image transferring section at the time of assembly of the recording unit to the image recording apparatus. Still however, the provision of the exclusively used protection cover to the recording unit leads to increase in mechanical components, and further, a space is required within the image recording apparatus so as to allow the protection cover to move to its retracted position relative to the recording unit. Furthermore, untransferred developer agent remaining on the photosensitive drum may adhere onto an inner surface of the protection cover to cause contamination, and the image recording apparatus may be soiled with the untransferred developer agent at the time of retraction of the protection cover.

SUMMARY OF THE INVENTION

The present invention has been established to overcome the above described deficiencies, and it is an object of the invention to provide a recording unit and an image recording apparatus capable of effectively protecting an electrostatic latent image carrier with a simple arrangement, and eliminating contamination to the recording unit and the image recording apparatus with developer agent.

These and other objects of the present invention will be attained by a recording unit detachably assemblable in an image recording apparatus comprising (a) an image carrying means which carries an electrostatic latent image, (b) a developing means for converting the latent image into a visible image with a developing material, the developing means being movable with respect to the image carrying means to a developing position where an opening portion is provided for transferring the visible image to an image recording sheet, and to a blockage position for closing the opening portion, and (c) a displacement means connected between the image carrying means and the developing means for moving the developing means to the blockage position.

In accordance with the present invention there is also provided a combination of a recording unit and an image recording apparatus which detachably assembles therein the recording unit. The recording unit comprises the image carrying means, the developing means, and the displacement means. The image recording apparatus comprises (a) a frame, (b) a lid member pivotally connected to the frame, (c) a holding member provided to the lid member for holding the recording unit therein, and (d) a drive means engageable with the recording unit for providing the developing position against the displacement means.

If a developing operation is not performed, the developing means is moved from the developing position to the blockage position where the electrostatic latent image carrying means is sealingly maintained for effectively protecting the same. The blockage position can be obtained by pivotally moving the lid member. That is, because of the geometrical relationship between the lid member, the holding member and the drive means, the drive means urges the developing means toward the blockage position from the developing position. Therefore, the image recording apparatus is not contaminated by the developing materials. On the other hand, if the lid member is closed, the developing means is automatically moved to the developing position so that the opening portion can be provided for the image transferring operation.

BRIEF DESCRIPTION OF THE DRAWINGS

In the drawings;

FIG. 4(*b*) is a schematic side view for particularly showing the recording unit and the associated mechanism and for description of the unit which is completely assembled in the apparatus;

DETAILED DESCRIPTION OF THE PREFERRED EMBODIMENTS

Figure 1:
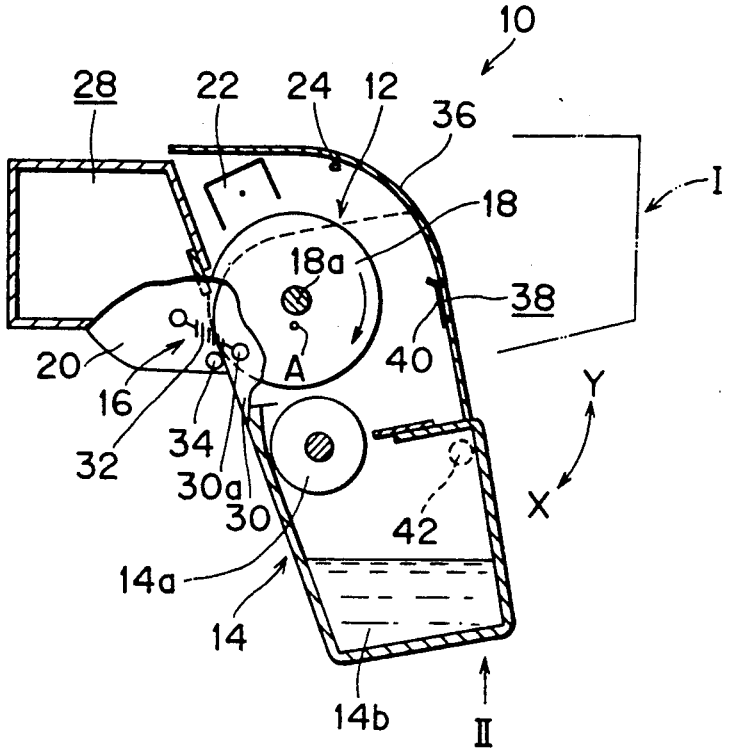
FIG. 1 is a partial schematic side cross-sectional view showing a light shielding state of a recording unit according to a first embodiment of the present invention.
Figure 5A:
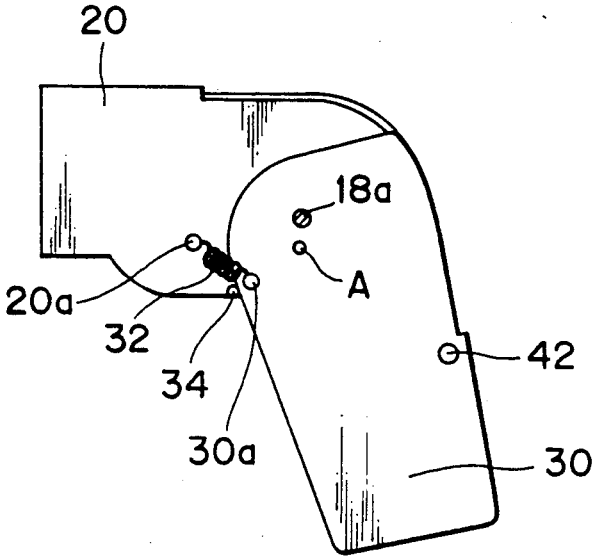
FIGS. 5(*a*) and 5(*b*) are schematic side views particularly showing external contours of first and second casings which constitute the recording unit, and FIG. 5(*a*) shows a blockage position and FIG. 5(*b*) shows an operating position of the recording unit.
Figure 5B:
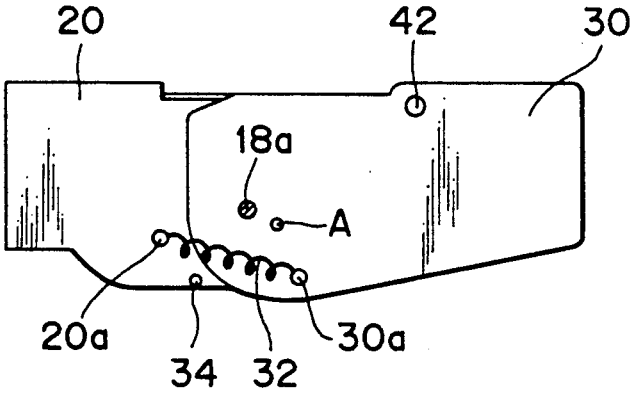

A recording unit and an image recording apparatus according to one embodiment of this invention will be described with reference to the drawings. The recording unit 10 includes a first casing 20 and a second casing 30 pivotally movable with respect to the first casing 20 about a pivot point A as shown in FIG. 1. The first and the second casing selectively provide a linear and L-shaped configuration in accordance with a pivoting motion of the second casing 30 as shown in FIGS. 5(*a*) and 5(*b*). The recording unit 10 generally includes an electrostatic latent image carrier or carrying means 12 for carrying an electrostatic latent image thereon, a developer or developer means 14 for developing the electrostatic latent image, and displacement means 16 for permitting the developing means 14 to relatively move with respect to the electrostatic latent image carrier means 12 into a developing position I and a blockage position II. The developing position I is provided by the linear orientation of the first and the second casings 20 and 30 shown by two dotted chain line in FIG. 1 where the developing means 14 performs developing with respect to the electrostatic latent image. The blockage position II is provided by the L shaped configuration of the first and the second casings 20, 30 as shown by a solid line in FIG. 1 where an opening portion 15 (see FIG. 2) for exposing the electrostatic latent image carrier means 12 to an image transfer region is blocked up by the pivotal motion of the second casing 30.

The electrostatic latent image carrier means 12 generally includes a photosensitive drum 18, a corona charger 22, and a film opening/closing member 24. A rotation shaft 18*a* is rotatably supported by the first casing 20, and the photosensitive drum 18 is drivingly mounted on the rotation shaft 18*a* to rotate the drum 18 in a direction indicated by an arrow in FIG. 1. The rotation shaft 18*a* is connected to a drive source (not shown). The corona charger 22 and the film opening/closing member 24 are stationarily fixed on the first casing 20. An electrostatic latent image is formed on an outer peripheral surface of the photosensitive drum 18, and the charger 22 is adapted for charging the drum surface.

Within the first casing 20, a cleaning means 26 is in contact with the photosensitive drum 18, and a developer agent collection chamber 28 is also provided in the first casing at a position adjacent the cleaning means 26 for accumulating developer agents released from the photosensitive drum 18 by the cleaning means 26.

The developer means 14 is accommodated in the second casing 30. The developer means 14 contains therein a developing agent 14*b*, and includes a developing roller 14*a* rotatably supported on the second casing 30 at a position in confrontation with the photosensitive drum 18. The second casing 30 is pivotably supported on the first casing 20 at a pivot point A so as to provide the above described blockage position II and the developing position I. The pivot point A is positioned offset from a rotation axis of the rotation shaft 18*a* as best shown in FIG. 1. The offsetting amount of the pivot point A with respect to the axis of the rotation shaft 18*a* is designed such that the developing roller 14*a* is spaced away from the photosensitive drum 18 at the blockage position II of the second casing 30, and the roller 14*a* is brought into surface contact with the photosensitive drum 18 at the developing position I (see FIG. 2, and it should be noted that the rotation shaft 18*a* which mounts thereon the photosensitive drum 18 has a stationary position, since the shaft 18*a* is supported on the first casing 20.)

The recording unit 10 provides an opening portion 15 where an image formed by the developer agent on the photosensitive drum 18 is transferred to a recording medium (described later in detail). Importantly, the opening portion 15 is closed when the second casing 30 has the blockage position II, and is opened when the latter has the developing position I (see FIG. 2).

The displacement mèans 16 includes a coil spring 32 interposed between first and second pins 20*a* and 30*a* extending from the first and the second casings 20 and 30, respectively. The displacement also includes a pin 34 fixed to the first casing 34. Because of the biasing force of the coil spring 32, the second casing 30 is urged in a direction X to provide the blockage position II. The pin 34 projects from the first casing 20 for restraining excessive pivotal movement of the second casing 30 and for determining the blockage position II because of the abutment of the pin 34 with an end face of the second casing 30. As described above, because of the angular displacement of the second casing 30, the developing roller 14*a* can be positioned away from the photosensitive drum 18 accommodated in the first casing 20.

The second casing 30 is also provided with a light shieldable and flexible cover 36. Therefore, in accordance with the pivotal movement of the second casing 30, the light shieldable cover 36 is also moved in sliding contact with the stationary first casing 20. The cover 36 is formed with a slit 38 to allow light, which carries imaging information, to pass therethrough for forming the electrostatic latent image on the photosensitive drum 18. However, the slit 38 is closed by a light shieldable film 40 when the second casing 30 is at its blockage position II. More specifically, one end of the light shieldable film 40 is fixedly secured to the cover 36, and another end of the light shieldable film 40 is normally urged toward the slit. (In FIG. 1, a lower end of the film 40 is secured to the cover 36, and an upper end of the film 40 is urged in a clockwise direction for closing the slit 38. With this structure, if the second casing 30 is pivotally moved in a direction Y to provide the developing position I, the cover member 36 is slidingly moved with respect to the first casing 20, so that the another end of the shieldable film 40 is brought into engagement with the film opening/closing member 24 fixed to the first casing 20. Therefore, the another end of the film 40 is opened by the film opening/closing member 24 (see FIG. 2) for opening the slit 38.

The second casing 30 is also provided with a pair of cylindrical pins 42 engageable with a pair of support plates 56 (described later) of an image recording apparatus, when the recording unit 10 is assembled into the image recording apparatus.

Figure 2:
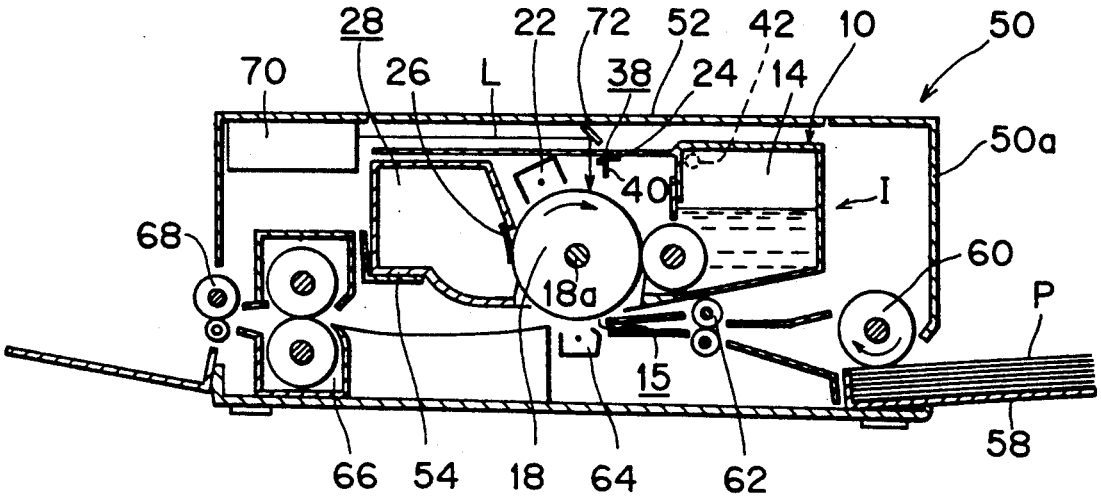
FIG. 2 is a schematic side cross-sectional view showing an image recording apparatus and the recording unit assembled therein for providing a developing position according to one embodiment of the present invention.
Figure 3:
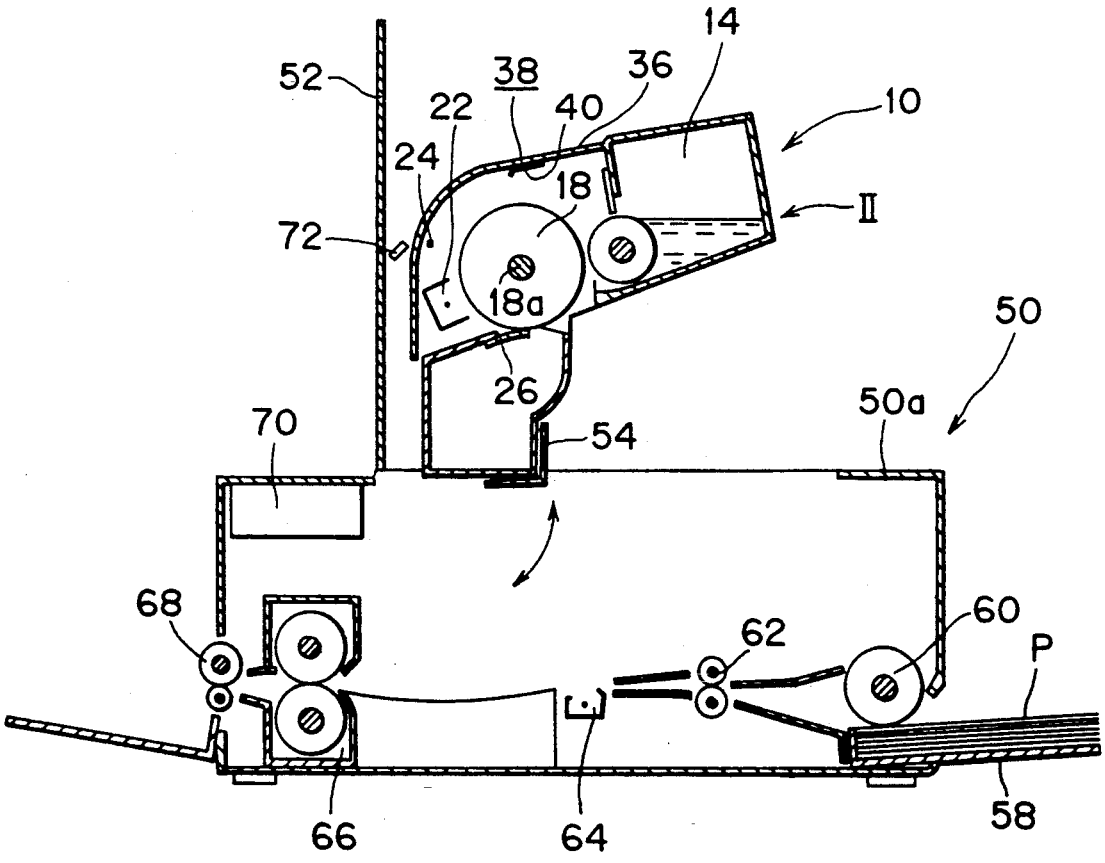
FIG. 3 is a schematic side cross-sectional view showing the image recording apparatus and the recording unit which has a blockage position according to the one embodiment.

FIGS. 2 and 3 show an overall structure of the image recording apparatus 50. The image recording apparatus includes a frame 50*a*, and a lid member 52 pivotally movable with respect to the frame. The lid member 52 has an open position (FIG. 3) for assembling or disassembling the recording unit 10 into and from the apparatus, and a close position (FIG. 2) for performing the image developing operation. Further, a holding member 54 is provided integrally with the lid member 52 for holding the first casing 20 of the recording unit 10. The holding member 54 is movable together with the pivotal movement of the lid member 52. Furthermore, the pair of support plates 56 (see FIGS. 4(*a*) and 4(*b*)) are stationarily disposed within the frame 50*a*. Each of the support plates 56 has an upper end portion formed with a guide surface 56*a* abuttable on each of the pins 42 extending from the second casing 30. That is, prior to the assembly of the recording unit 10 into the apparatus 50, the unit has L-shaped configuration to provide the blockage position II by the biasing force of the coil spring 32. When this recording unit 10 is assembled into the image recording apparatus 50, the pins 42 are brought into abutment with the guide surfaces 56*a* of the support plate 56 and are slidingly moved thereon, so that the second casing 30 is forcibly moved toward the developing position I to provide a linear orientation relative to the first casing 20 against the biasing force of the coil spring 32.

At a lower one end portion of the frame 50*a*, a sheet feed tray 58 is provided, in which a stack of a plurality of image recording media such as recording sheets P are stored. At a position above the tray 58, a sheet feed roller 60 is rotatably disposed for feeding an uppermost sheet P of the sheet stack, and a pair of transfer rollers 62 are disposed between the sheet feed roller 60 and the recording unit 10 assembled in the frame 50*a* for feeding the sheet P toward the unit 10. Further, a transfer charger 64 is disposed in confrontation with the opening portion 15. On the other hand, at a lower another end portion of the frame 50*a*, a fixing unit 66 and a sheet discharge roller 68 are provided. Apparently, a sheet feed path is provided from one lower end to the other lower end of the frame 50*a* through the image transfer section defined by the opening portion 15 of the recording unit 10.

Within the frame 50*a*, and at a position above the fixing unit 66, a scanning means 70 is provided. The scanning means 70 is provided with a laser generator (not shown), a rotation mirror (not shown) and f$\theta$ lens for generating a laser light beam L. The scanning means is movable in a direction perpendicular to an axial direction of the photosensitive drum 18. A reflection mirror 72 is fixed on the lid member 52 for directing the light beam L from the scanning means 70 toward the photosensitive drum 18 through the slit 38.

In operation of the image recording apparatus 50 housing therein the recording unit 10, the photosensitive drum 18 is rotated in a direction indicated by the arrow in FIG. 2 through the rotation shaft 18*a* by the drive source (not shown). At the same time, the photosensitive drum 18 is charged by the corona charger 22. The light beam L from the scanning means 70 is scanned onto the photosensitive drum 18 to provide the electrostatic latent image thereon. The latent image is converted into a visible image by means of the developing means 14 in such a manner that the developer agent is transferred onto the photosensitive drum 18 in conformance with the latent image.

On the other hand, each one of the recording sheets P on the tray 58 is fed to the image transfer section through the feed roller 60 and the pair of transfer rollers 62. At the image transfer section given by the opening portion 15 and the charger 64, the developer agent image on the photosensitive drum 18 is then transferred onto the recording sheet P. The recording sheet P carrying the visible image thereon is then fed to the fixing unit 66 where the developer image is fixed, and is then discharged out of the frame 50*a* through the discharge roller 68. The developer agent remaining on the photosensitive drum 18 is removed therefrom by the cleaning means 26, and is accumulated in the developer agent collection chamber 28.

Next, assembling or disassembling work of the recording unit 10 with respect to the image recording apparatus 50 will next be described. Description is given on the premise that the recording unit 10 has already been assembled in the apparatus 50.

Figure 4A:
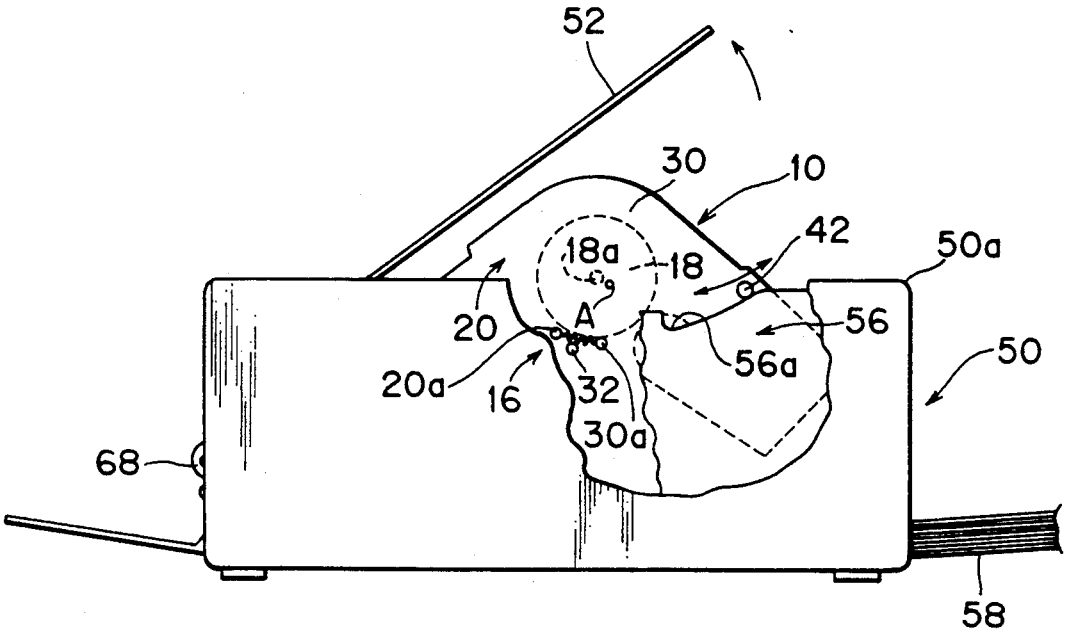
FIG. 4(*a*) is a schematic side view for particularly showing a pivotal arrangement of the recording unit and an associated mechanism of the recording apparatus and for description of the recording unit which is about to be disassembled from the recording apparatus.

First, the lid member 52 is pivotally moved to its open position as shown in FIG. 3. In this case, the lid member 52 and the holding member 54 are both integrally moved upwardly, so that the first casing 20 held by the holding member 52 is also angularly moved. In accordance with the upward movement of the first casing 20. The pair of pins 42 extending from the second casing 30 gradually slides over the guide surfaces 56*a* of the support plates 56 as shown in FIG. 4*a*, so that the second casing 30 is pivotally moved about the pivot point A by the biasing force of the spring 32 to finally obtain the L-shaped blockage position II. When the lid member 52 is completely opened, the developer means 14 is completely separated from the electrostatic latent image carrying means 12 for protecting the carrying means 12, and at the same time, the opening portion 15 is also closed by the first and the second casings 20 and 30. Further, the light shieldable film 40 is also moved away from the film opening/closing member 24, so that the slit 38 is closed by the film 40 which is normally urged toward the slit 38. Thus, the recording unit 10 is completely shielded against light during the non-operative position of the developing operation.

Figure 4B:
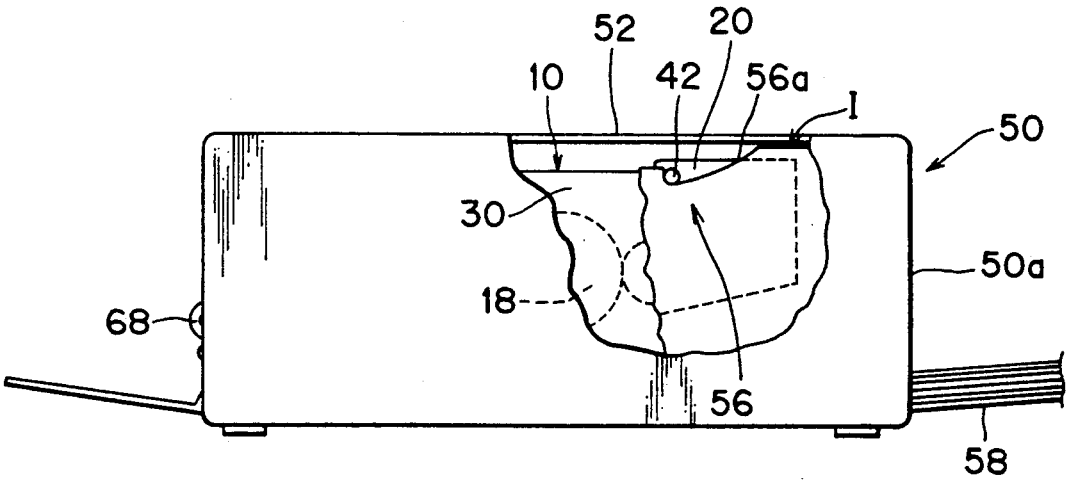

Then, the recording unit 10 is removed from the holding member 54, and a first casing 20 of a new recording unit 10 is inserted into the holding member 54. If the lid member 52 is pivotally moved to its closed position, the pair of pins 42 extending from the second casing 30 is gradually slidingly moved over the guide surface 56*a* of the support plates 56 against the biasing force of the coil spring 32, so that the second casing 30 has an orientation substantially linearly with respect to the first casing 20 as shown in FIG. 4(*b*). When the lid member 52 is completely closed, the developing means 14 is positioned at its developing position I where the developing roller 14*a* is in contact with the photosensitive drum 18 of the electrostatic latent image carrying means 12. At the same time, the opening portion 15 is opened to allow an image transferring operation, and simultaneously, the film 40 attached to the cover member 36 is moved toward the film opening/closing member 24. That is, the latter is entered into the other end of the film 40 so as to pivotally move the film 40 about the one end, whereby the slit 38 can be opened. (It should be noted that the film 40 is attached to the cover 36 which, together with the pivotal movement of the second casing 30, is slidingly moved relative to the first casing 20 attached with the film opening/closing member 24. Thus, the laser beam light can be applied to the photosensitive drum 18 through the opened slit 38.

In the foregoing embodiment, by the opening motion of the lid member 52, the recording unit 10 can have an up-standing position through the supporting member 54, and the second casing 30 accommodating therein the developing means 14 can be automatically moved to its blockage position II because of the biasing force of the coil spring 32 (see also FIG. 5(*a*)). Therefore, the opening portion 15 which has been opened at the image transferring region can be automatically closed by the first and the second casings 20 and 30 in order to effectively prevent the developer agent from being leaked through the opening portion 15. Accordingly, contamination to the internal portion of the image recording apparatus is avoidable with the developer agents. Further an additional protection cover is not required for avoiding the leakage of the developer agent, to thereby reduce numbers of mechanical components, and it is unnecessary to provide a space in the image recording apparatus for retracting the protection cover into the space. As a result, a compact apparatus results.

Further, when the recording unit 10 has the blockage position II, the photosensitive drum 18 can be automatically covered by both the first and the second casings 20 and 30, and the slit 38 can be automatically closed by the film 40. Consequently, the photosensitive drum 18 can be protected against the external light irradiation, and any damage to the drum can be avoided. Moreover, since the pivot point A is positioned offset from the rotation axis of the photosensitive drum 18, the developing roller 14*a* can be moved away from the drum 18. As a result, replacement work to the photosensitive drum 18 can be facilitated.

Incidentally, explanation is made on the replacement work of the recording unit 10. However, the above described operation is also available for processing the sheet jamming.

As described above, according to the recording unit of the present invention, if a developing operation is not performed, the developing means is moved from the developing position to the blockage position so that the latent image carrying means is sealed from the image transfer region (the opening portion 15 is closed). Therefore, the electrostatic latent image carrying means is protected against external light and any damage. Further, according to the image recording apparatus of the present invention, the developing means can be moved to the blockage position and the developing position by way of the drive means such as the support plates 56 in accordance with the pivotal movement of the lid member. Therefore, replacement work to the recording unit, or checking thereto can be facilitated without any contamination to the image recording apparatus with the developing agent.

While the invention has been described in detail and with reference to specific embodiment thereof, it would be apparent to those skilled in the art that various changes and modifications may be made therein without departing from the spirit and scope of the invention.

What is claimed is:

1. A recording unit detachably assemblable in an image recording apparatus comprising:

an image carrying means which carries an electrostatic latent image;

a developing means for converting the latent image into a visible image with a developing material, the developing means being movable with respect to the image carrying means to a developing position where an opening portion is provided for transferring the visible image to an image recording sheet, and to a blockage position for closing the opening portion; and a displacement means connected between the image carrying means and the developing means for moving the developing means to the blockage position;

wherein the image carrying means comprises a first casing, a rotation shaft supported by the first casing and having a rotation axis, and a photosensitive drum mounted on the rotation shaft, and wherein the developing means comprises a second casing pivotally supported to the first casing at a pivot point, and a developing roller rotatably supported on the second casing, the pivot point being offset from the rotation axis.

2. The recording unit as claimed in claim 1, wherein the opening portion is provided by a space defined between the first and the second casings when the second casing is pivotally moved to the developing position, and the opening portion is closed by the first and the second casings when the second casing is pivotally moved to the blockage position.

3. The recording unit as claimed in claim 2, wherein the second casing extends linearly with respect to the first casing when the second casing is pivotally moved to the developing position for providing the opening portion, and the second casing is pivotally movable to the blockage position to provide a generally L shape in combination with the first casing to close the opening portion.

4. The recording unit as claimed in claim 2, wherein the developing roller is abuttable on the photosensitive drum when the second casing is pivotally moved to the developing position, and is moved away from the photosensitive drum when the second casing is pivotally moved to the blockage position.

5. The recording unit as claimed in claim 4, wherein the displacement means comprises a first pin extending from the first casing, a second pin extending from the second casing, and a coil spring connected between the first and the second pins for normally urging the second casing toward the blockage position.

6. The recording unit as claimed in claim 5, wherein the displacement further comprises a stop means extending from the first casing, the stop means being abuttable with the second casing for defining the blockage position thereof.

7. The recording unit as claimed in claim 6, further comprising at least one slide pin extending from the second casing, the slide pin being slidingly engageable with the image recording apparatus for providing the developing position against the biasing force of the coil spring.

8. The recording unit as claimed in claim 1, wherein the image carrying means further comprises a charger fixed to the first casing for charging the photosensitive drum, and a cleaning means for removing the developing material from the photosensitive drum.

9. The recording unit as claimed in claim 1, further comprises a shutter means comprising:

a cover member provided integrally with the second casing and formed with a slit through which a light is passable;

a light shieldable film member positioned at the slit and having a base end fixed to the second casing and a free end urged toward the slit for covering the slit; and a film opening member fixed to the first casing, and abuttable on the free end of the light shieldable film member when the second casing is pivotally moved to the developing position.

10. A combination of a recording unit and an image recording apparatus which detachably assembles therein the recording unit, the recording unit comprising:

an image carrying means which carries an electrostatic latent image;

a developing means for converting the latent image into a visible image with a developing material, the developing means being movable with respect to the image carrying means to a developing position where an opening portion is provided for transferring the visible image to an image recording sheet, and to a blockage position for closing the opening portion; and a displacement means connected between the image carrying means and the developing means for moving the developing means to the blockage position; and the image recording apparatus comprising:

a frame;

a lid member pivotally connected to the frame;

a holding member provided to the lid member for holding the recording unit therein; and a drive means engageable with the recording unit for providing the developing position against the displacement means;

wherein the carrying means comprises a first casing, a rotation shaft supported by the first casing and having a rotation axis, and a photosensitive drum mounted on the rotation shaft, and wherein the developing means comprises a second casing pivotally supported to the first casing at a pivot point, and a developing roller rotatably supported on the second casing, the pivot point being offset from the rotation axis.

11. The combination as claimed in claim 10, wherein the holding member holds therein the first casing, and wherein the drive means comprises at least one support plate abuttable on the second casing for providing the developing position against the displacement means.

12. The combination as claimed in claim 11, wherein the displacement means comprises a first pin extending from the first casing, a second pin extending from the second casing, and a coil spring connected between the first and the second pins for normally urging the second casing toward the blockage position.

13. The combination as claimed in claim 12, wherein the recording unit further comprises at least one slide pin extending from the second casing, and wherein the at least one support plate has a guide surface on which the slide pin is slidingly movable, the slide pin being slidingly movable in one direction on the guide surface in accordance with an opening movement of the lid member for providing the blockage position by the biasing force of the coil spring, and the slide pin being slidingly movable in a second direction on the guide surface in accordance with a closing movement of the lid member for providing the developing position against the biasing force of the coil spring.

* * * * *